US011867059B2

(12) United States Patent
Staack et al.

(10) Patent No.: US 11,867,059 B2
(45) Date of Patent: Jan. 9, 2024

(54) SYSTEMS AND METHODS FOR FORMING A SUBTERRANEAN BOREHOLE

(71) Applicant: The Texas A&M University System, College Station, TX (US)

(72) Inventors: David Staack, College Station, TX (US); Li-Jung Tai, Bryan, TX (US); Dion S. Antao, College Station, TX (US); Xin Tang, College Station, TX (US)

(73) Assignee: The Texas A&M University System, College Station, TX (US)

( * ) Notice: Subject to any disclaimer, the term of this patent is extended or adjusted under 35 U.S.C. 154(b) by 245 days.

(21) Appl. No.: 17/288,648

(22) PCT Filed: Oct. 30, 2019

(86) PCT No.: PCT/US2019/058859

§ 371 (c)(1),
(2) Date: Apr. 26, 2021

(87) PCT Pub. No.: WO2020/092559

PCT Pub. Date: May 7, 2020

(65) Prior Publication Data

US 2021/0396079 A1 Dec. 23, 2021

Related U.S. Application Data

(60) Provisional application No. 62/752,407, filed on Oct. 30, 2018.

(51) Int. Cl.

| | |
|---|---|
| ***E21B 7/15*** | (2006.01) |
| ***E21B 4/02*** | (2006.01) |
| ***E21B 10/42*** | (2006.01) |
| ***E21B 41/00*** | (2006.01) |

(52) U.S. Cl.

CPC ..... *E21B 7/15* (2013.01); *E21B 4/02* (2013.01); *E21B 10/42* (2013.01); *E21B 41/0085* (2013.01)

(58) Field of Classification Search

CPC ..... E21B 7/15

See application file for complete search history.

(56) References Cited

U.S. PATENT DOCUMENTS

| | | | | |
|---|---|---|---|---|
| 3,679,007 | A | 7/1972 | O'Hare | |
| 5,106,164 | A | 4/1992 | Kitzinger et al. | |
| 5,738,178 | A * | 4/1998 | Williams | E21B 4/02 175/73 |
| 7,270,195 | B2 | 9/2007 | MacGregor et al. | |
| 7,416,032 | B2 | 8/2008 | Moeny et al. | |
| 8,746,265 | B2 | 6/2014 | Nilsson et al. | |
| 9,822,588 | B2 | 11/2017 | Kocis | |
| 2006/0037779 | A1 | 2/2006 | Moeny et al. | |

(Continued)

OTHER PUBLICATIONS

PCT/US2019/058859 International Search Report and Written Opinion dated Mar. 19, 2020 (12 p.).

(Continued)

*Primary Examiner* — Giovanna Wright
(74) *Attorney, Agent, or Firm* — Conley Rose, P.C.

(57) ABSTRACT

Systems and methods for drilling a borehole are disclosed. In an embodiment, the system includes a drill bit and a plasma inducing apparatus coupled to the drill bit. The plasma inducing apparatus is configured to generate plasma.

20 Claims, 7 Drawing Sheets

(56) References Cited

U.S. PATENT DOCUMENTS

| | | | |
|---|---|---|---|
| 2009/0133929 | A1 | 5/2009 | Rodland |
| 2013/0277116 | A1 | 10/2013 | Knull et al. |
| 2014/0008968 | A1 | 1/2014 | Moeny |
| 2014/0209308 | A1* | 7/2014 | Baldasaro ..... C04B 40/0003 166/293 |
| 2015/0167439 | A1 | 6/2015 | Kasevich et al. |
| 2016/0017663 | A1* | 1/2016 | Moeny ..... E21B 17/003 175/327 |
| 2017/0058608 | A1 | 3/2017 | Fraser et al. |
| 2017/0067292 | A1 | 3/2017 | Bayol et al. |
| 2017/0204669 | A1 | 7/2017 | Lehr et al. |
| 2017/0350206 | A1 | 12/2017 | Kocis et al. |
| 2018/0209217 | A1 | 7/2018 | Moeny et al. |

OTHER PUBLICATIONS

European Patent Application No. 19880290.2 extended European search report dated May 11, 2022 (9 pages).

* cited by examiner

SYSTEMS AND METHODS FOR FORMING A SUBTERRANEAN BOREHOLE

CROSS-REFERENCE TO RELATED APPLICATIONS

This application is a 35 U.S.C. § 371 national stage application of PCT/US2019/058859 dated Oct. 30, 2019, and entitled "Systems and Methods for Forming a Subterranean Borehole," which claims benefit of U.S. provisional patent application Ser. No. 62/752,407 filed Oct. 30, 2018, and entitled "Drill Head and Drilling Method Using Targeted Energy Focusing to Induce Micro-Cracking," each of which is hereby incorporated herein by reference in its entirety for all purposes.

STATEMENT REGARDING FEDERALLY SPONSORED RESEARCH OR DEVELOPMENT

This invention was made with government support under DE-EE0008605 awarded by the Department of Energy. The government has certain rights in the invention.

BACKGROUND

Holes or bores (e.g., such as wellbores, or other boreholes) may be formed or extended in a subterranean formation by engaging a drill bit with the formation. The cost of drilling a borehole may be very high and is proportional to the length of time it takes to drill to the desired depth and location. The time required to drill the borehole, in turn, is greatly influenced by the rate at which the drill bit can drill the borehole through the subterranean formation, which may be referred to herein as the "rate of penetration" (ROP).

BRIEF SUMMARY

Some embodiments disclosed herein are directed to a system for drilling a borehole. In an embodiment, the system includes a tubular string, and a drill bit coupled to the tubular string. In addition, the system includes a plasma inducing apparatus coupled to the drill bit, and a power conversion assembly coupled to the tubular string. The plasma inducing apparatus is configured to generate plasma from electric current generated within the power conversion assembly.

In other embodiments the system includes a tubular string, and a bottom hole assembly coupled to the tubular string. The bottom hole assembly includes a downhole motor, a power conversion assembly configured to generate electric current from operation of the downhole motor, a drill bit, and an electrode assembly coupled to a downhole end of the drill bit. The electrode assembly is configured to generate plasma when energized with electric current from the power conversion assembly.

Other embodiments disclosed herein are directed to a method of drilling a borehole. In an embodiment, the method includes: (a) rotating a drill bit about a central axis; (b) engaging the drill bit with a subterranean formation during (a); (c) generating electric current downhole; (d) generating plasma from a plasma inducing apparatus coupled to the drill bit during (b) using the electric current generated in (c); (e) weakening the subterranean formation with the plasma during (d); and (f) extending the borehole within a subterranean formation as a result of (a)-(e).

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which.

DETAILED DESCRIPTION

Figure 1:
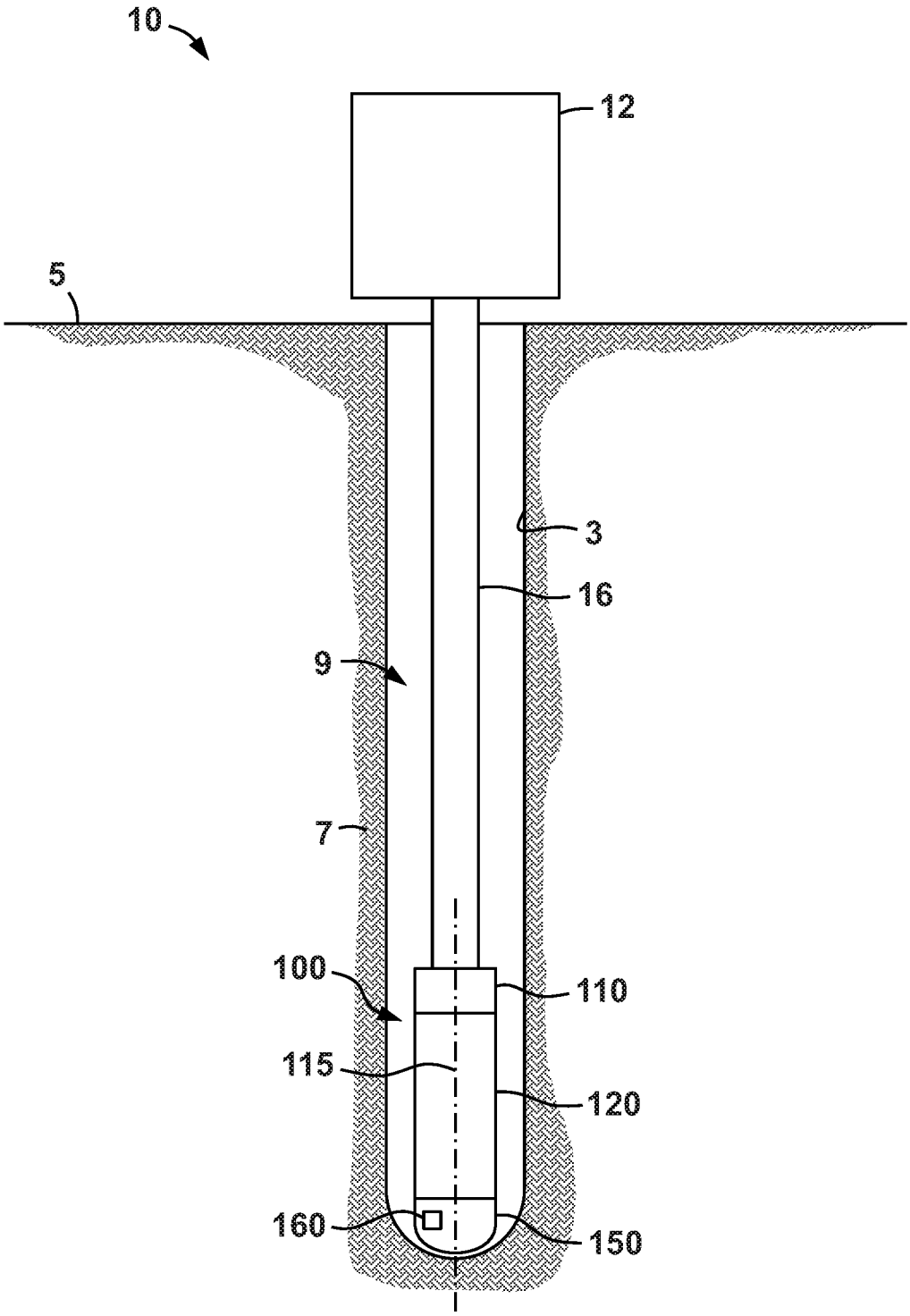
FIG. 1 is a schematic view of a system for drilling a borehole in a subterranean formation according to some embodiments.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial"

and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims will be made for purposes of clarity, with "up", "upper", "upwardly" "upstream", "uphole" meaning toward the surface of the borehole and with "down", "lower", "downwardly" "downstream" or "downhole" meaning toward the terminal end of the borehole, regardless of the borehole orientation. As used herein, the terms "approximately," "about," "substantially," and the like mean within 10% (i.e., plus or minus 10%) of the recited value. Thus, for example, a recited angle of "about 80 degrees" refers to an angle ranging from 72 degrees to 88 degrees. As used herein, the term "elongate" when used to refer to a body, means that the longitudinal or axial length of the body is longer than its lateral or radial width.

As previously described, the cost of drilling or forming a subterranean borehole may be directly related to the ROP of the drill bit forming the borehole. Thus, it is generally desirable to increase the ROP of a borehole drilling operation so as to reduce the costs associated therewith. A given drill bit may have a higher ROP for formations that are weaker or that present less resistance to shearing, puncturing, etc. as a result of engagement of the drill bit. Thus, it may be desirable to weaken the subterranean formation prior to or simultaneously with engaging the formation with the drill bit so as to increase the ROP during a drilling operation. Accordingly, examples disclosed herein include drill bits and associated drilling systems or assemblies that include electrode assemblies that are configured to weaken a subterranean formation that is to be engaged by the drill bit and thereby increase the ROP during a drilling operation.

In the specific embodiments disclosed herein, drill bits are described for drilling or forming a borehole in a subterranean formation for accessing hydrocarbons (e.g., oil, gas, condensate, etc.). However, it should be appreciated that the drill bits and associated systems described herein may be employed within any system for forming a subterranean borehole, regardless of the purpose of such a borehole formation. For instance, in some embodiments, the disclosed drill bits (and/or the associated drilling systems) may be utilized to form a subterranean borehole for accessing other resources (e.g., such as ground water), or to form a pathway through a subterranean formation for conduits, cables, fluids, and/or other mechanisms or substances. Further, in some embodiments, embodiments of the disclosed drill bits and/or drilling systems may be utilized to form bores or holes in other mediums (that is, other than a subterranean formation). For instance, in some embodiment, embodiments of the disclosed drill bits may be utilized to drill holes in teeth (e.g., such as for dental applications), walls, structures, etc. Thus, any specific reference to the forming of boreholes for accessing subterranean hydrocarbon resources is merely meant to provide one example implantation of the disclosed embodiments, and should not be interpreted as limiting all potential uses thereof.

Referring now to FIG. 1, a schematic view of an embodiment of a system 10 for drilling a borehole 3 in a subterranean formation 7 is shown. In general, system 10 includes surface equipment 12, a tubular drill string 16, and a bottom-hole assembly (BHA) 100.

In this example, drill string 16 includes a plurality of elongate pipe joints connected together end-to-end. In some embodiments, the elongate pipe joints may be threadably coupled to one another; however, any suitable coupling mechanism or method may be used to join the elongate pipe joints in various embodiments. The drill string 16 may be supported by and extended from the surface equipment 12 into borehole 3. During operations, drill string 12 may both support the BHA 100 within borehole 3 and provide a flow path for fluids, such as, for instance, drilling mud, into the borehole 3 during drilling operations. In some embodiments, drill string 16 may comprise any other suitable tether (e.g., such as wireline, slickline, e-line, coiled tubing, etc.) for supporting BHA 100 within borehole 3 that may or may not also comprise or define a fluid flow path therethrough.

The BHA 100 is coupled to a distal or downhole end of the drill string 16 within borehole 3. In this embodiment, BHA 100 includes a central or longitudinal axis 115, a downhole motor 110, a power conversion assembly 120, and a drill bit 150. Generally speaking, the power conversion assembly 120 is axially positioned between the downhole motor 110 and drill bit 150.

During drilling operations, drill bit 150 is rotated with weight-on-bit (WOB) applied to drill the borehole 3 through the earthen formation 7. In this embodiment, drill bit 150 is rotated by the downhole motor 110. In other embodiments, surface equipment 12 may include additional components for rotating tubular string 16 and drill bit 150 (e.g., such as a rotary table, top drill, power swivel, etc.). In still other embodiments, the drill bit 150 may be rotated by a combination of the downhole motor 110 and additional, surface-mounted components (e.g., such as those noted above).

Referring still to FIG. 1, while drilling borehole 3, a suitable drilling fluid is pumped under pressure from the surface 5 through the drill string 16. The drilling fluid flows down drill string 16, through the BHA 100, and is ultimately discharged at the bottom of borehole 3 through nozzles (not shown) in face of drill bit 150 (described in more detail below). Thereafter, the drilling fluid circulates uphole to the surface 5 through an annular space or annulus 9 radially positioned between tubular string 16 and the sidewall of borehole 3.

Further, during these operations and as will be described in more detail below, power conversion assembly 120 generates electric current, which is utilized to selectively generate plasma at one or more electrode assemblies 160 disposed on the face of drill bit 150. The plasma creates cracks and fractures within the formation 7 proximal drill bit 150 so as weaken the formation 7, thereby offering the potential to increase the ROP of the drilling operation. Additional details of these operations as well as embodiments of the BHA 100 are discussed in more detail below.

Figure 2:
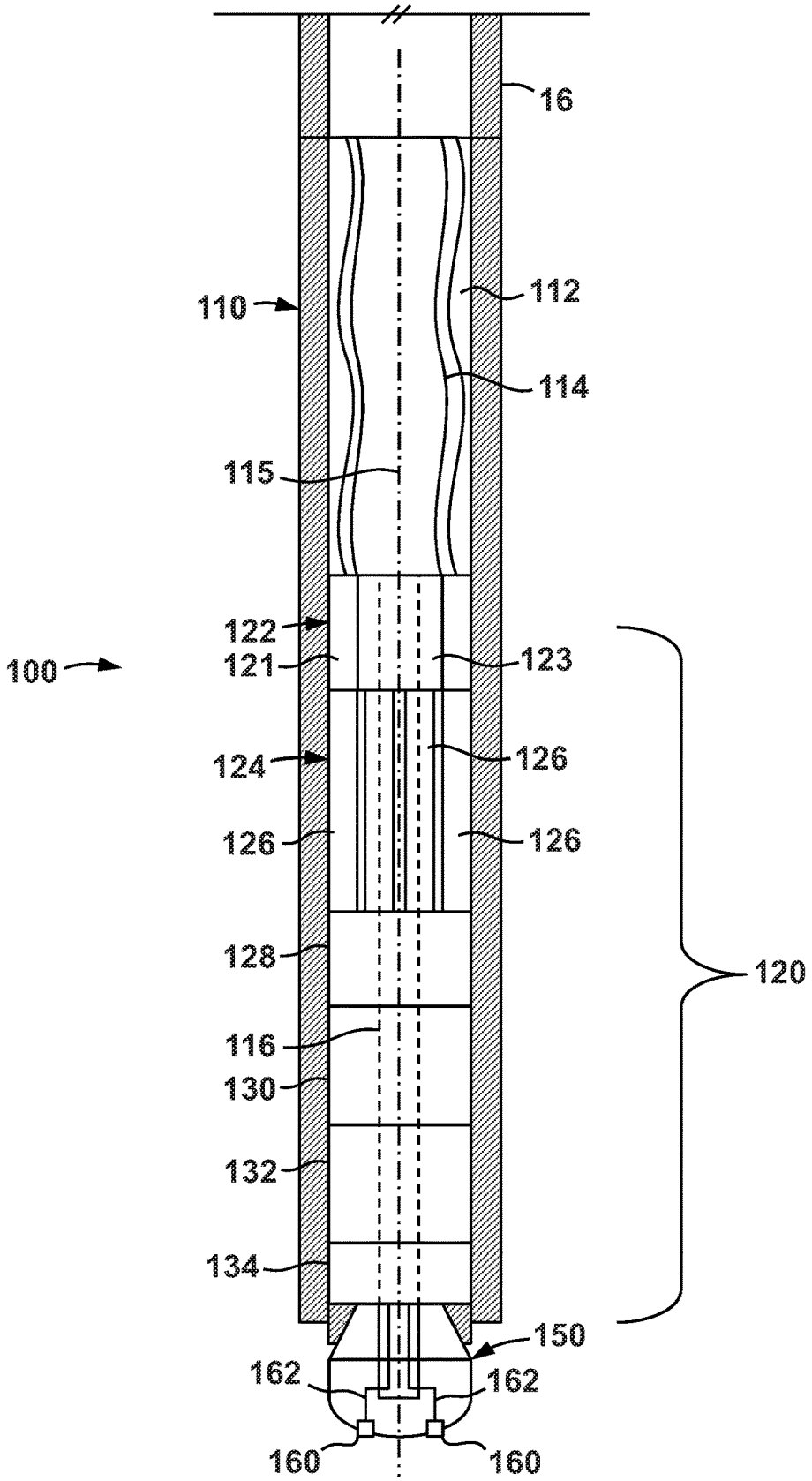
FIG. 2 is a schematic, partial side cross-sectional view of the bottom hole assembly of the system of FIG. 1 according to some embodiments.

Referring now to FIG. 2, in some embodiments downhole motor 110 may comprise progressive cavity or positive displacement motor that is driven via the flow of pressurized drilling fluid therethrough. In particular, the downhole motor 110 includes a rotor 114 rotatably disposed within a stator 112. The rotor 114 includes a shaft formed with one or more helical vanes or lobes extending along its length. In addition, the stator 112 is formed of an elastomer liner bonded to the inner wall of the stator housing that defines helical lobes complementary to that of the lobe or lobes of the rotor 114. During operations, pressurized drilling fluid is flowed between the rotor 114 and stator 112, thereby driving rotor 114 to rotate within the stator 112 in an eccentric manner. More particularly, the rotor 114 generally orbits about the central longitudinal axis of the stator 112, which is coaxially aligned with central axis 115, while simultaneously rotating about a central axis (not shown) of the rotor 112.

A driveshaft assembly 116 is coupled between a downhole end of rotor 114 and the drill bit 150. Drive shaft assembly 116 includes one or more shafts, joints (e.g., universal joints), connectors (not shown), or combinations thereof that transfer torque from the rotor 114 to drill bit 150. Thus, driveshaft assembly 116 converts the precessional or orbital motion of the rotor 114 into rotation of drill bit 150 about central axis 115. In addition, while not specifically shown, it should be appreciated that driveshaft assembly 116 may also include one or more bearing assemblies for reducing friction and generally supporting the rotational motion of driveshaft assembly 116 and drill bit 150 during drilling operations.

It should be appreciated that the design of downhole motor 110 may be varied in other embodiments. For instance, in some embodiments downhole motor 110 may be configured to rotate rotor 114 concentrically about axis 115 (e.g., rather than precessionally or eccentrically as previously described above). Accordingly, the design of driveshaft assembly 116 may also be varied so as to correspond with the design and arrangement of downhole motor 110 during drilling operations.

Referring still to FIG. 2, as previously described above, power conversion assembly 120 is axially disposed between downhole motor 110 and drill bit 150 within BHA 100. The components of power generation assembly 120 may be generally disposed circumferentially about driveshaft assembly 116. In addition, while not specifically shown, a fluid flow path may be defined through driveshaft assembly 116 and/or between driveshaft assembly 116 and the power conversion assembly 120 to communicate drilling fluid flowing through the downhole motor 110 to the drill bit 150, where is it then emitted from one or more nozzles (not shown) in the drill bit 150.

Generally speaking, power conversion assembly 120 generates electric current from the rotation of rotor 114 within downhole motor 110, and then supplies that electric current to the drill bit 150 so as to selectively generate plasma (or "plasmatic discharges") from the electrode assemblies 160 during drilling operations. In addition, as will be described in more detail below, power conversion assembly 120 may also multiply or increase a voltage of the generated electric current, so as to achieve a desired power discharge via the electrode assemblies 160. In this embodiment, power conversion assembly 120 includes an alternator 122, a power storage assembly 124, an inverter 128, a transformer 130, a voltage multiplier and rectifier 132, and a power distribution assembly 134.

Alternator 122 generates a flow of electric current utilizing the rotational motion of the rotor 114 and/or driveshaft assembly 116 during drilling operations. In particular, in some embodiments, alternator 122 includes a rotor 123 that is rotatably coupled to driveshaft assembly 116 so that as driveshaft assembly 116 is rotated about central axis 115, rotor 123 is also rotated about the central axis 115. Alternator 122 also includes one or more coils 121 wound circumferentially about the rotor 123. During drilling operations, as the driveshaft assembly 116 rotates about the central axis 115 (e.g., via the orbiting motion of rotor 114 within downhole motor 110 as previously describe above), the rotor 123 rotates within the coils 121, which thereby generate a magnetic field that in turn induces an electric current flow within the coils 121.

Power storage assembly 124 is disposed downhole of alternator 122 and stores electric power generated by alternator 122. In particular, power storage assembly 124 includes a plurality power storage devices 126 (e.g., batteries, capacitors, etc.), electrically coupled to one another and to the coils 121 within alternator 122. In this embodiment, the power storage devices 126 are batteries (e.g., 12 Volt batteries, 48 Volt batteries, etc.). Thus, power storage devices 126 may also be referred to herein as "batteries 126." The batteries 126 may be coupled to one another in series (e.g., such that a positive terminal of each battery 126 is electrically coupled to a negative terminal of another of the batteries 126), or in parallel (e.g., such that all of the positive terminals of batteries 126 are coupled to one another and all of the negative terminals of batteries 126 are coupled to one another). The choice between series connection or parallel connection between the batteries 126 may be driven by a desired output voltage from the power storage assembly 124 to the other components within power conversion assembly 120, the power storage capacity of the batteries 126, etc.

In this embodiment, the batteries 126 within power storage assembly 124 are elongate cylindrical bodies that are parallel to and radially offset from central axis 115. More specifically, the batteries 126 are uniformly circumferentially spaced about central axis 115 and driveshaft assembly 116. However, it should be appreciated that batteries 126 may have alternative shapes or forms, and/or the batteries 126 may have alternative arrangements or orientations within the power conversion assembly 124 in other embodiments.

Referring still to FIG. 2, inverter 128 is positioned downhole of and electrically coupled to the power storage assembly 124. Thus, during drilling operations, electric current flows from batteries 126 of power storage assembly 124 to inverter 128. The electric current produced from batteries 126 may be direct current (DC). Generally speaking, during operations, inverter 128 converts the DC current provided from batteries 126 to alternating current (AC). In general, inverter 128 may comprise any suitable circuit(s) and/or other mechanisms for affecting the conversion of DC current to AC current.

Transformer 130 is positioned downhole of inverter 128 and increases the voltage of the AC current emitted from inverter 128 to a higher, desired voltage. In some embodiments, the transformer 130 may receive an input current (e.g., from inverter 128) having a voltage of about 12 to 400 V (AC) and may produce an output current having a voltage of about 1 kV (AC) to about 50 kV (AC). In some specific embodiments, the transformer 130 may receive an input current having a voltage of about 12 V (AC) and produce an output current having a voltage of about 3 kV (AC), or may receive an input current having a voltage of about 120 V (AC) and produce an output current having a voltage of about 10 kV (AC). While not specifically shown, it should be appreciated that transformer 130 may, in some embodiments, comprise one or more coils or windings that create a varying magnetic field when energized with an electric current (e.g., such as an electric current supplied from inverter 128), so as to induce an output electric current (e.g., an output AC electric current) at a different (e.g., in this case higher) voltage than the input electric current.

Voltage multiplier and rectifier 132 is disposed downhole of and electrically coupled to transformer 130. Thus, during drilling operations, the AC electric current output from transformer 130 is supplied to voltage multiple and rectifier 132. In some embodiments, the voltage multiplier and rectifier 132 may comprise a Cockcroft-Walton generator, and thus, may be generally referred to herein as a "generator 132." During drilling operations, generator 132 generates a high voltage DC current based on the AC current received from transformer 130. In addition to effectively converting the AC electric current from transformer 130 into DC current, the DC current output from generator 132 also has a higher voltage than the input AC current supplied from transformer 130. In some embodiments, the DC current output from generator 132 has a voltage potential of approximately 10 kV or greater (e.g., approximately 50 kV). In addition, in some embodiments, the DC current output from generator 132 has a current of approximately 10 mA (however, currents above and below 10 mA are also contemplated herein).

The relatively high output DC electric current from the generator 132 is then supplied to the power distributor 134. Power distributor 134 may comprise one or more circuits, controllers, and/or other devices that selectively emit the output electric current from generator 132 to the electrode assemblies 160 coupled to drill bit 150. In particular, in some embodiments, power distributor 134 provides electric current to the electrode assemblies 160 in a desired sequential order or pattern. In some embodiments, the sequence or sequential order for providing electric current to the various electrode assemblies 160 is tailored and configured to weaken a portion or surface of the formation 7 prior to (or simultaneous with) engaging that surface or portion of the formation 7 with the drill bit 150. In some embodiments, the speed in which the energization sequence for the electrode assemblies 160 is carried out may be dictated or based on a rotational speed of the drill bit 150 (e.g., about axis 115) during drilling operations.

In at least some embodiments, power distributor 134 rapidly transfers or applies a relatively high voltage electric current to the electrode assemblies 160. For instance, in some embodiments, the power distributor 134 transfers or applies about 10 volts per nanosecond (V/ns) or greater to the electrode assemblies 160 during drilling operations. In some embodiments, the power distributor 134 transfers or applies greater than or equal to about 500 V/ns to the electrode assemblies 160 during drilling operations. Without being limited to this or any other theory, a relatively rapid transfer of higher voltage electric current to the electrode assemblies 160 may allow for relatively low energy, high voltage pulses to be generated within the liquids filling the borehole 3, regardless of the conductivity of the liquids.

Figure 3:
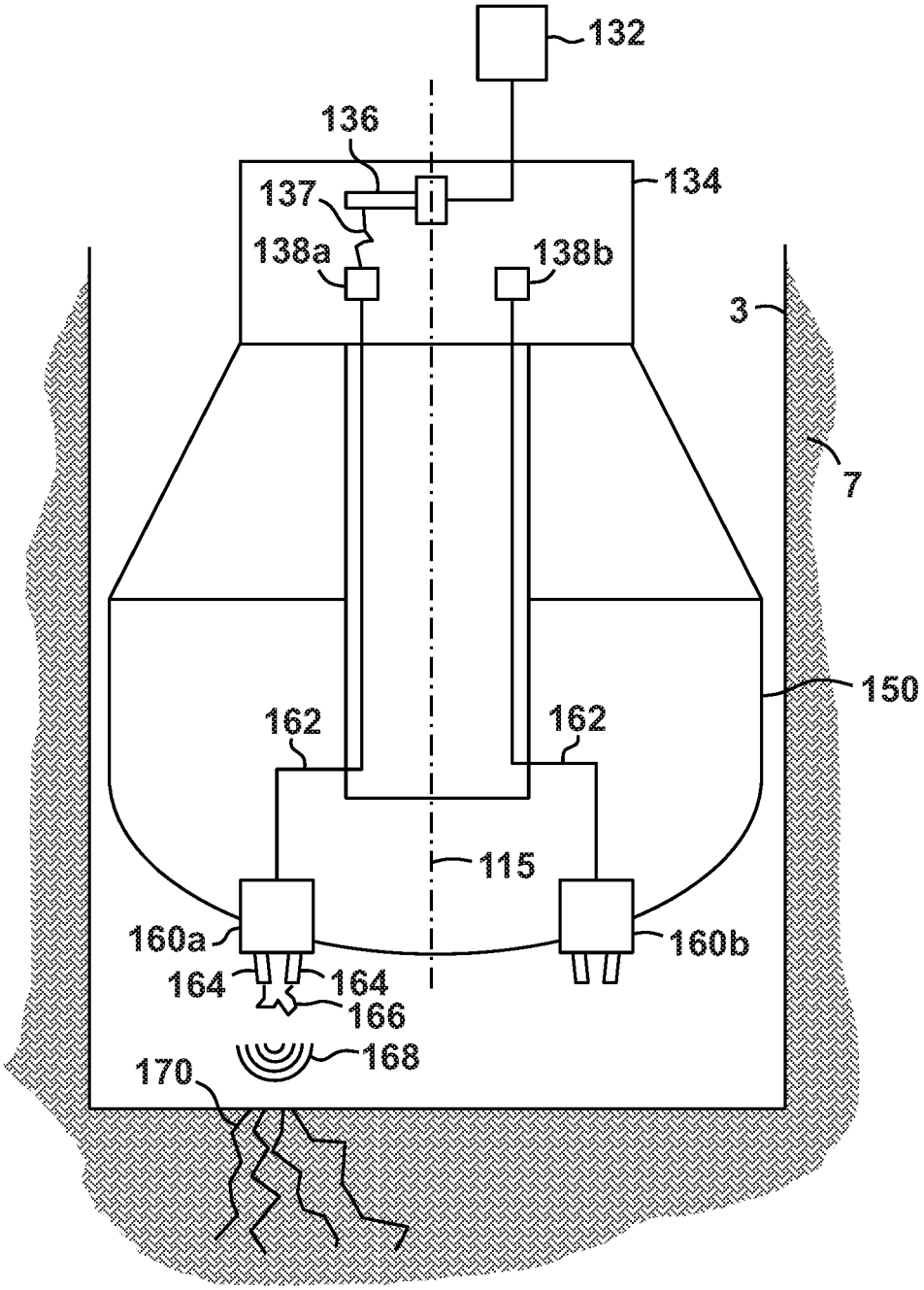
FIG. 3 is an enlarged schematic view of the power distribution assembly and drill bit of the system of FIG. 1 according to some embodiments.

Referring now to FIGS. 2 and 3, in some embodiments, power distributor 134 includes a plurality of electrical contacts 138*a*, 138*b* that are coupled to the electrode assemblies 160 within drill bit 150. In particular, in the embodiment shown in FIG. 3, power distributor 134 includes a first electrical contact 138*a* coupled to a first electrode assembly 160*a* disposed within drill bit 150, and a second electrical contact 138*b* coupled to a second electrode assembly 160*b* within drill bit 150. The electrical contacts 138*a*, 138*b* are coupled to the electrode assemblies 160*a*, 160*b* via a pair of communication paths 162, which may comprise any suitable mechanism or device configured to conduct electrical current therethrough (e.g., such as a wire, cable, conductive trace, etc.). The electrical contacts 138*a*, 138*b* are circumferentially arranged or spaced about central axis 115. In some embodiments, the contacts 138*a*, 138*b* are uniformly-circumferentially spaced about axis 115. Thus, in the embodiment shown in FIG. 3, the two electrical contacts 138*a*, 138*b* are circumferentially spaced about 180° from one another about axis 115 (i.e., electrical contacts 138*a*, 138*b* radially oppose one another across central axis 115). However, as will be described in more detail below, the arrangement, number, and spacing of the electrode assemblies 160 on drill bit 150 may be varied in different embodiments.

Referring still to FIGS. 2 and 3, power distributor 134 also includes a conductive tip 136. The power distributor 134 is coupled to driveshaft assembly 116 and/or drill bit 150 so that the rotation of driveshaft assembly 116 and drill bit 150 about axis 115 also drives a relative rotation between the tip 136 and the electrical contacts 138*a*, 138*b*. In particular, in some embodiments, the electrical contacts 138*a*, 138*b* may rotate about central axis 115 along with drill bit 150 and driveshaft assembly 116, relative to the conductive tip 136. The conductive tip 136 may be spaced (e.g., in an axial direction with respect to central axis 115) from the electrical contacts 138*a*, 138*b*, and may be energized with electric current from the generator 132. Thus, during rotation of the drill bit 150 and the relative rotation of the electrical contacts 138*a*, 138*b*, the tip 136 is progressively brought into close proximity to each of the contacts 138*a*, 138*b*. When tip 136 is sufficiently close the contacts 138*a*, 138*b*, electric current "jumps" from the tip 136 to the corresponding electrical contact 138*a*, 138*b* via an arc 137 (e.g., such as shown between the tip 136 and electrical contact 138*a* in FIG. 3). Thereafter, the electric current flows from the electrical contact to the corresponding electrode assemblies 160*a*, 160*b* in drill bit 150 via the conductive paths 162. In some embodiments, the tip 136 may physically engage with contacts 138*a*, 138*b* so as to conduct electrical current therebetween during drilling operations.

Generally speaking, each electrode assembly 160*a*, 160*b* includes a pair of outwardly extending electrodes 164 spaced apart from one another. When electric current is conducted to the electrode assemblies 160*a*, 160*b* via conductive paths 162 (e.g., such as when electric current is conducted from the tip 136 to the corresponding electrical contacts 138*a*, 138*b* as described above), the electric current may be conducted into at least one of the electrodes 164 whereby it may again "jump" to the other electrode 164 via an arc 166. Arc 166 may be referred to herein as a plasmatic discharge or plasma that generates increased temperatures and pressures. Thus, the electrode assemblies 160*a*, 160*b* (as well as electrode assemblies 160 discussed more broadly herein and shown in FIGS. 1, 2, and 4-6) may be referred to herein as "plasma inducing" devices or apparatuses that generate plasma (e.g., arc 166). During drilling operations, the electrodes 164 may be disposed relatively close to a surface of the formation 7 within borehole 3, such as, for instance within 1 cm or less, or within 1 mm or less. Large gradients accompanying the formation of plasma 166 may also induce shock waves 168 and cavitation within the fluid disposed in the borehole 3 (e.g., drilling fluid, water, etc.). The induced shockwaves 168 impact formation 7 and thereby form fractures 170 (e.g., cracks, micro-cracks, etc.). In some embodiments, the shockwaves 168 may apply elevated pressures to the formation 7 that are greater than or equal to 1 GPa. As a result, the formation 7 is generally weakened so that drill bit 150 may more easily shear, puncture, etc. the formation 7 and therefore extend borehole 3 during drilling operations.

In some embodiments, the average electrical power for generating plasma 166 between the select pairs of electrodes 164 in electrode assemblies 160*a*, 160*b* may be less than 20 kW, or may be less than 5 kW (e.g., such as from about 100 W to about 10 kW). Also, the plasma 166 may be generated rapidly between the electrodes 164, with instantaneous (or near instantaneous) power release of about 10 MW or greater, and may have an energy release of about 10 Joules (J) to about 10 kJ.

In addition, the electrical pulse or current conducted to the electrode assemblies 160*a*, 160*b* via conductive paths 162 may be either monopoloar or bipolar. In some embodiments, the electrical or current conducted to the electrode assemblies 160*a*, 160*b* is monopolar and of the electrode 164 of each electrode assembly 160*a*, 160*b* may receive electric current having a voltage of about 10 kV to about 100 kV. In some embodiments, one of the electrodes 164 of each electrode assembly 160*a*, 160*b* may be coupled to a ground potential. In some embodiments, the electrical current conducted to electrode assemblies 160*a*, 160*b* may be bipolar, and one electrode 164 within each electrode assembly 160*a*, 160*b* may receive a positively biased electric current, while the other electrode 164 of each electrode assembly 160*a*, 160*b* may receive a negatively biased electric current, wherein the positive and negative biases are made with reference to a ground potential.

In some embodiments, the duration of the plasmatic discharges (e.g., arcs 166) may occur relatively quickly between electrodes 164. For instance, in some embodiments, the duration of the plasmatic discharges between electrodes 164 may be 10 nanoseconds (ns) or less, or from about 1 ns to about 1 microsecond (μs). Additionally, in some embodiments, the plasmatic discharges between electrodes 164 may occur at frequencies of about 1 Hz to about 1 kHz.

In general, drill bit 150 may be any suitable type or design of drill bit for forming borehole 3 in subterranean formation 7. For instance, drill bit 150 may be a fixed cutter drill bit (e.g., which is sometimes referred to as a "drag bit") that shears portions of the formation 7 to extend borehole 3. In some embodiments, drill bit 150 may be a rolling cone drill bit 150 that punctures and crushes the formation 7 to extend borehole 3. In still other embodiments, drill bit 150 may be another form of drill bit (e.g., including hybrid designs incorporating elements of a fixed cutter and rolling cone drill bit). In the following discussion, a drill bit that may be used as drill bit 150 within BHA 100 according to some embodiments is described in more detail; however, as noted above, it should be appreciated that the drill bit 150 may comprise a number of different designs that may differ from those specifically discussed below.

Figure 4:
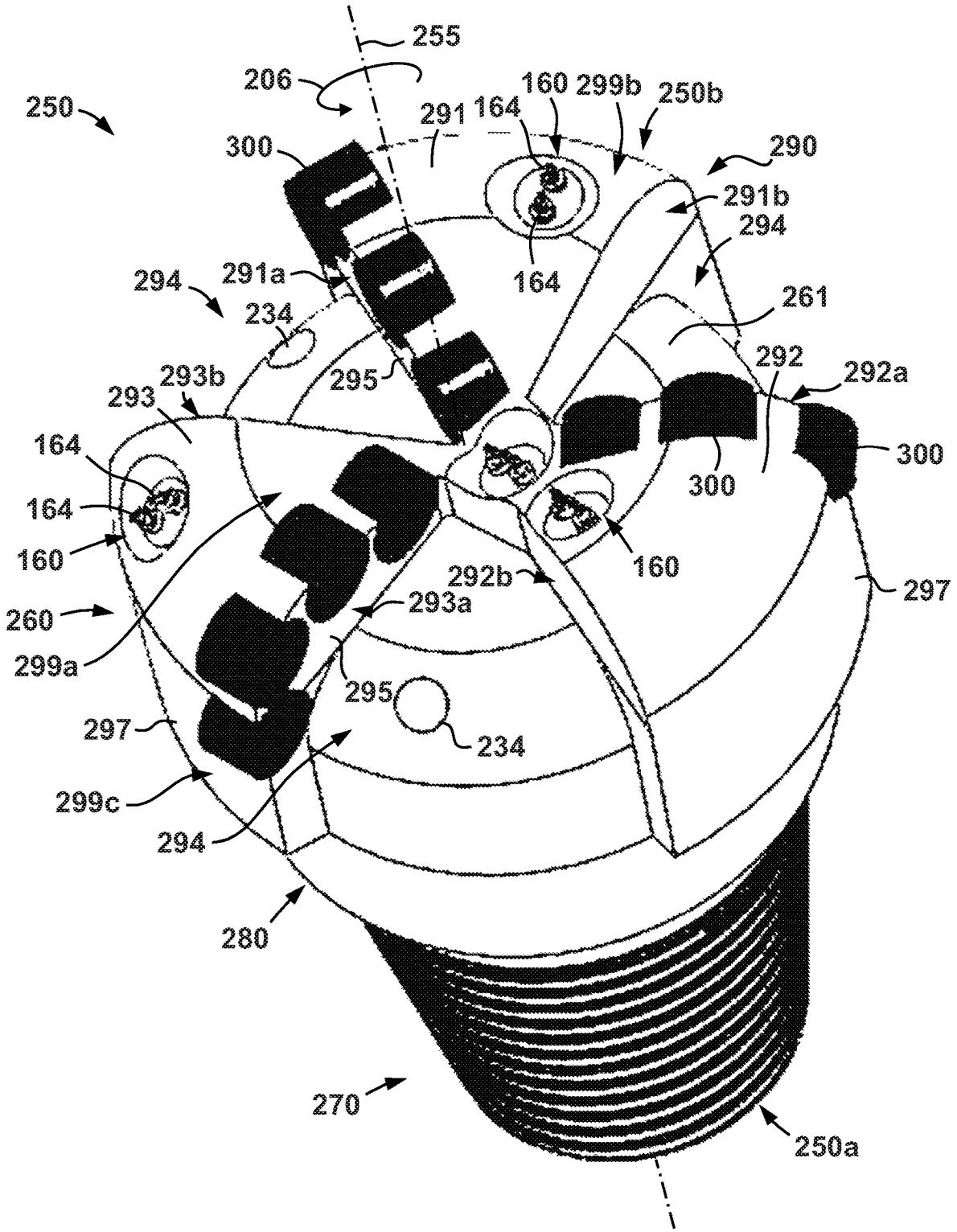
FIG. 4 is a perspective view of a drill bit for use within the system of FIG. 1 according to some embodiments.
Figure 5:
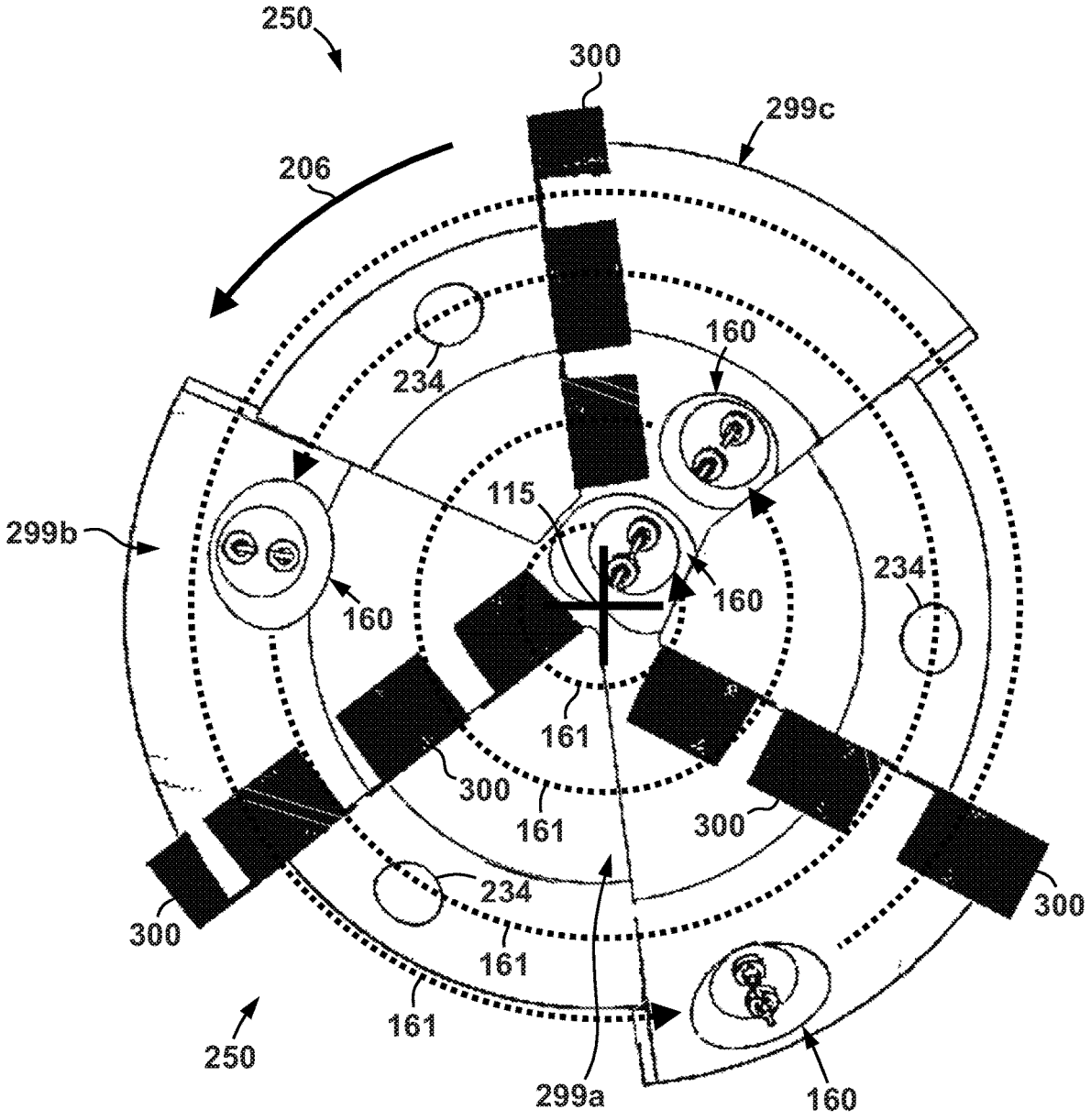
FIG. 5 is a bottom end view of the drill bit of FIG. 4.
Figure 6:
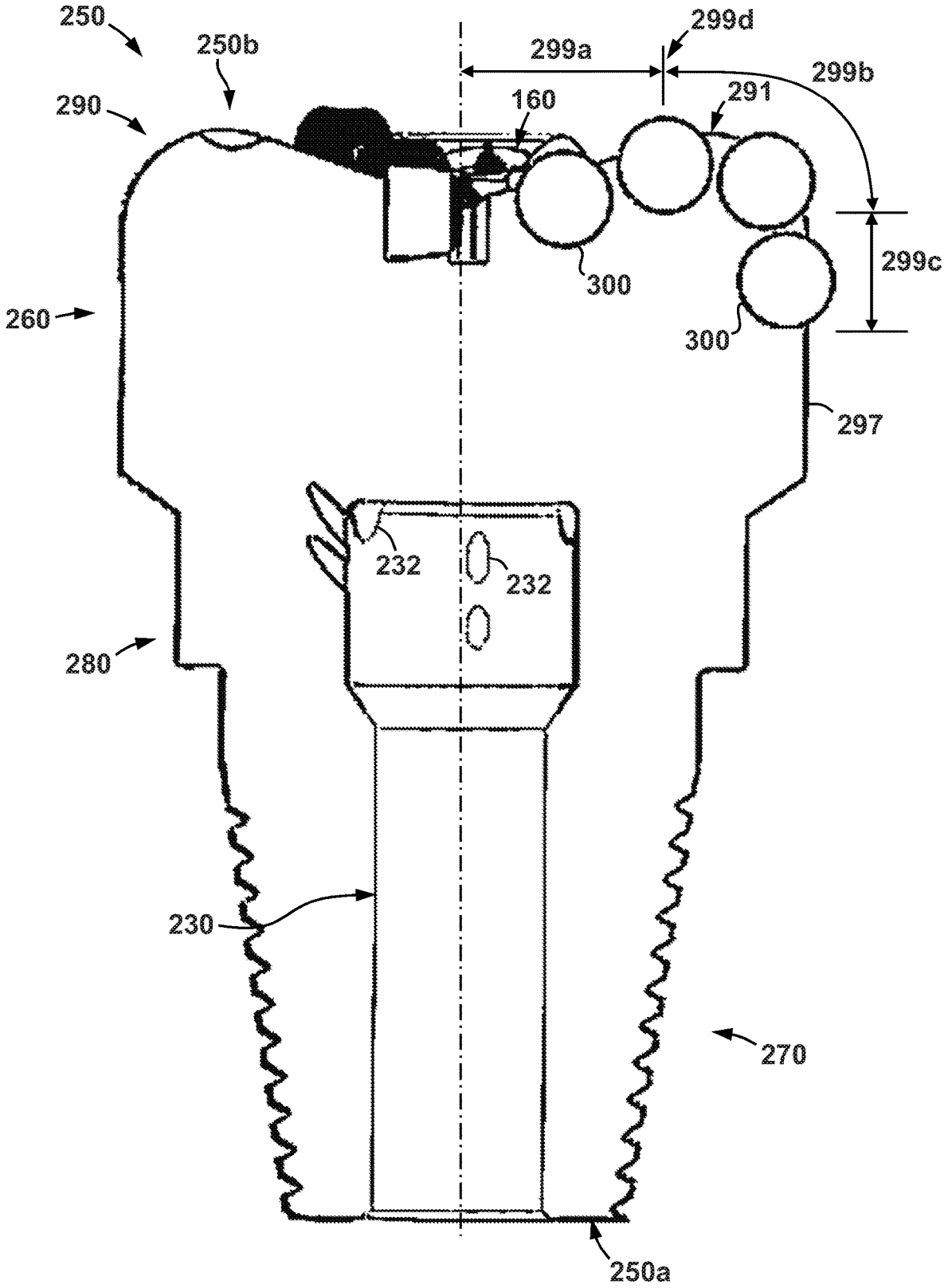
FIG. 6 is a cross-sectional side view of the drill bit of FIG. 4.

Referring now to FIGS. 4-6, a drill bit 250 that may be used as drill bit 150 within BHA 100 according to some embodiments is shown. In this embodiment, drill bit 250 includes a so-called fixed cutter drill bit that is configured to shear off portions of a subterranean formation (e.g., formation 7) to extend a borehole (e.g., borehole 3) therein.

Generally speaking, drill bit 250 has a central or longitudinal axis 255, a first or uphole end 250*a*, and a second or downhole end 250*b*. Central axis 255 of bit 250 is coaxially aligned with central axis 115 of BHA 110 when bit 250 is coupled within BHA 100 as drill bit 150 (see e.g., FIGS. 2 and 4-6). Drill bit 250 is configured to rotate about axis 255 in a cutting direction represented by arrow 206. In addition, bit 250 includes a bit body 260 extending axially from downhole end 250*b*, a threaded connection or pin 270 extending axially from uphole end 250*a*, and a shank 280 extending axially between pin 270 and body 260. Pin 270 couples bit 250 to BHA 100 (see e.g., FIG. 2). Bit body 260, shank 280, and pin 270 are coaxially aligned with axis 255, and thus, each has a central axis coincident with axis 255.

The portion of bit body 260 that faces the formation at downhole end 250*b* includes a bit face 261 provided with a cutting structure 290. Cutting structure 290 includes a plurality of blades 291, 292, 293, which extend from bit face 291. In this embodiment, the plurality of blades 291, 292, 293 are uniformly circumferentially-spaced on bit face 261 about bit axis 255.

In this embodiment, blades 291, 292, 293 are integrally formed as part of, and extend from, bit body 260 and bit face 261. In particular, blades 291, 292, 293 extend generally radially along bit face 261 and then axially along a portion of the periphery of bit 250. Blades 291, 292, 293 are separated by drilling fluid flow courses or junk slots 294. Each blade 291, 292, 293 has a leading edge or side 291*a*, 292*a*, 293*a*, respectively, and a trailing edge or side 291*b*, 292*b*, 293*b*, respectively, relative to the direction of rotation 206 of bit 250.

Referring still to FIGS. 4-6, each blade 291, 292, 293 includes a cutter-supporting surface 295 for mounting a plurality of cutter elements 300. In particular, cutter elements 300 are arranged adjacent one another in a radially extending row along the leading edge 291*a*, 292*a*, 293*a* of each blade 291, 292, 293. In this embodiment, each cutter element 300 is a generally cylindrical member that includes a relatively hard material for engaging with and shearing portions of a subterranean formation (e.g., formation 7) during operations. In some embodiments, the cutter elements 300 may comprise polycrystalline diamond.

Bit body 260 further includes gage pads 297 of substantially equal axial length measured generally parallel to bit axis 255. Gage pads 297 are circumferentially-spaced about the radially outer surface of bit body 260. Specifically, one gage pad 297 intersects and extends from each blade 291, 292, 293. In this embodiment, gage pads 297 are integrally formed as part of the bit body 260. In general, gage pads 297 can help maintain the size of the borehole by a rubbing action when cutter elements 300 wear slightly under gage. Gage pads 297 also help stabilize bit 250 against vibration.

Referring specifically now to FIG. 6, a cross-section of drill bit 250 is shown that shows a profile of with a first blade 291; however, it should be appreciated that each of the blades 291, 292, 293 is generally configured the same, such that the portions and components of the profile of blade 291 are also present along the blades 292, 293. In this embodiment, the profile of blades 291, 292, 293 (as shown by the representation of the profile of blade 291 in FIG. 6) may generally be divided into three regions conventionally labeled cone region 299*a*, shoulder region 299*b*, and gage region 299*c*. Cone region 299*a* includes the radially innermost region of bit body 260, and extends from bit axis 255 to shoulder region 299*b*. In this embodiment, cone region 299*a* is generally concave. Adjacent cone region 299*a* is the generally convex shoulder region 299*b*. The transition between cone region 299*a* and shoulder region 299*b*, typically referred to as the nose 299*d*. Moving radially outward, adjacent shoulder region 299*b* is the gage region 299*c* which extends substantially parallel to bit axis 105 at the outer radial periphery of composite blade profile 148. Gage pads 297 define the gage region 299*c* and an outer radius of bit body 260. Cutter elements 300 are provided in cone region 299*a*, shoulder region 299*b*, and gage region 299*c*.

As is also best shown in FIG. 6, bit 250 includes an internal plenum 230 extending axially from uphole end 250*a* through pin 270 and shank 280 into bit body 260. Plenum 230 permits drilling fluid to flow from the tubular string 16 (see e.g., FIGS. 1 and 2) into bit 250. Flow passages 232 extend from plenum 230 to downhole end 250*b*. As best shown in FIGS. 4 and 5, nozzles 234 are seated in the lower end of each flow passage 232. The nozzles 234 and corresponding flow passages 232 distribute drilling fluid around cutting structure 290 to flush away formation cuttings and to remove heat from cutting structure 290, and more particularly cutter elements 300, during drilling.

Referring again to FIGS. 4-6, the plurality of electrode assemblies 160 are disposed about the cutting structure 290. As best shown in FIGS. 4 and 5, in this embodiment the electrode assemblies 160 are disposed within the cone region 299*a* and the shoulder region 299*b*. In this embodiment, no electrode assemblies 160 are included within the gage region 299*c*; however, it should be appreciated that in other embodiments, one or more of the electrode assemblies 160 may be included within the gage region 299*c*. Also, in some embodiments (e.g., such as the embodiment of FIGS. 4-6), the electrode assemblies 160 may be recessed within the cutting structure 290 so as to protect electrodes 164 from impacting the formation (e.g., formation 7) or other components or features during a drilling operation.

In addition, as is best shown in FIG. 5, in this embodiment the electrode assemblies 160 are disposed at different radial positions relative to central axes 115, 225 such that each electrode assembly 160 traces or sweeps through a different orbit 161 about axis 115, 255 as drill bit 150 rotates about axes 115, 255 in the cutting direction 206. In particular, each orbit 161 is radially spaced from the other orbits 161, so that each electrode assembly 160 interacts with a different portion of the formation 7 (see e.g., FIG. 3) during drilling operations. In this embodiment, there are total of four electrode assemblies 160 so that during operations, the electrode assemblies trace four different orbits 161 that are radially spaced moving radially outward form the central axes 115, 255. In some embodiments, the electrode assemblies 160 are arranged so that the orbits 161 are generally uniformly radially spaced; however, in other embodiments, one or more of the orbits 161 traced by the electrode assemblies 160 may not be evenly radially spaced from one another.

Referring now to FIGS. 3 and 6, in some embodiments the conductive paths 162 electrically coupling electrode assemblies 160 to power distribution assembly 132 are routed (e.g., at least partially) through the plenum 230 of drill bit 150. In addition, while not specifically shown, it should be appreciated that conductive paths 162 may also be routed through additional bores or tunnels extending from plenum to electrode assemblies 160. In some embodiments, conductive paths 162 may extend through one or more of the flow passages 232 in addition to the plenum 230. In still other embodiments, conductive paths 162 may extend through tunnels or pathways within drill bit 150 that do not extend through and/or intersect with the plenum 230 or flow passages 232.

Figure 7:
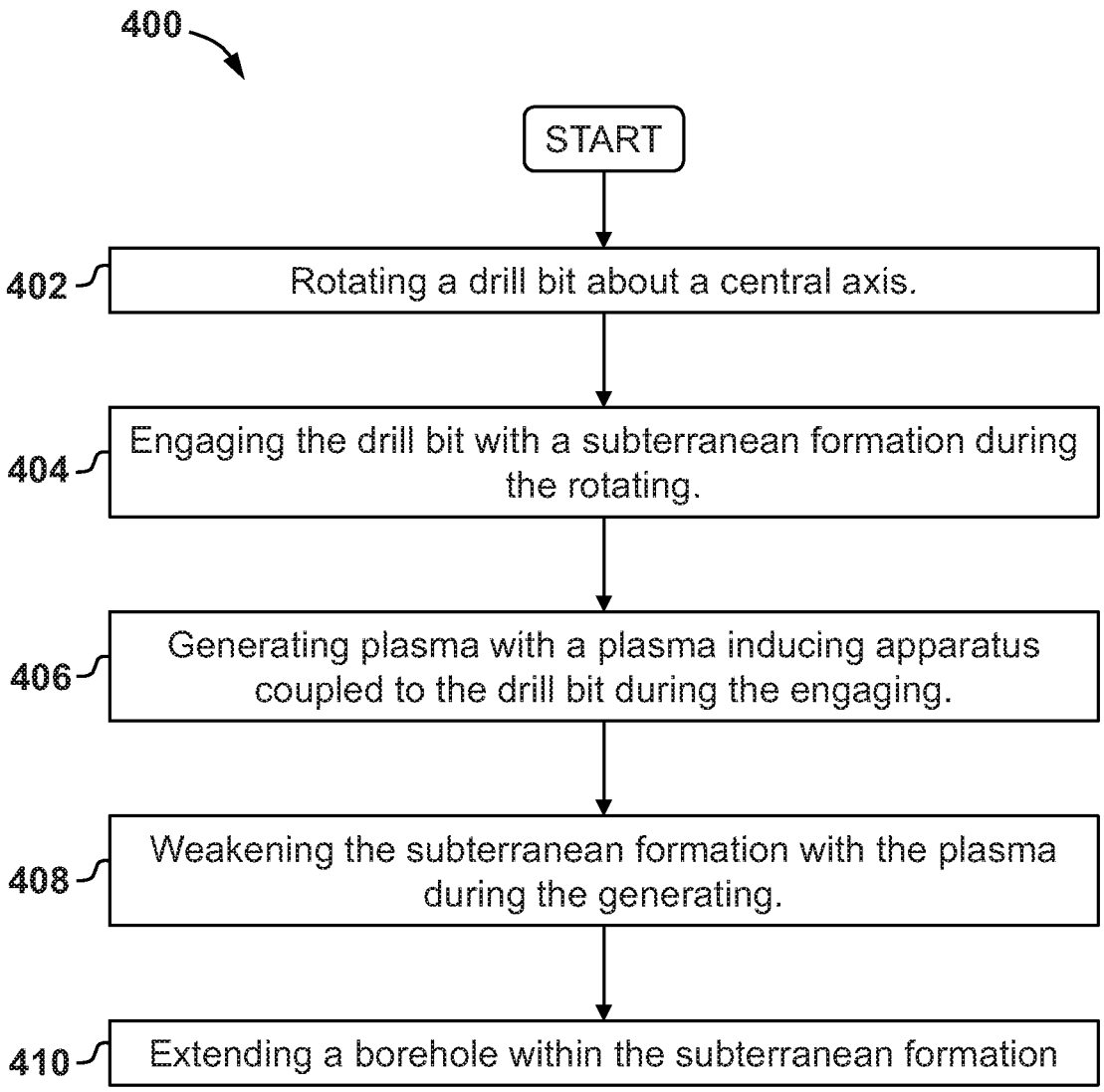
FIG. 7 is a flow chart illustrating a method of drilling a borehole in a subterranean formation according to some embodiments.

Referring now to FIG. 7, an embodiment of a method 400 for drilling a borehole (e.g., such as borehole 3 in FIG. 1) is shown. In describing the features of method 400, reference will be made to the features of system 10 shown in FIGS. 1-3; however, it should be appreciated that method 400 may be performed with other system and assemblies that may be different from those described above for system 10. Thus, reference to system 10 and its components and features (e.g., BHA 100, drill bit 150, drill bit 250, etc.) is merely meant to describe particular embodiments of method 400 and should not be interpreted as limiting all potential embodiments of method 400.

Initially, method 400 begins by rotating a drill bit about a central axis at block 402. For instance, a drill bit (e.g., drill bit 150, 250) may be rotated about a central axis of the drill bit and/or of a bottom hole assembly (e.g., BHA 100, central axis 115). Next, method 400 includes engaging the drill bit with a subterranean formation during the rotating at block 404. In some embodiments, the engaging at block 404 may comprise shearing the formation with a cutting structure of the drill bit (e.g., cutting structure 290 of drill bit 250), and/or puncturing the formation with the drill bit (e.g., such as for a rolling cone drill bit).

Next, method 400 includes generating plasma with a plasma inducing apparatus coupled to the drill bit during the engaging at block 406. For instance, in some embodiments, the plasma inducing apparatus may comprise an electrode assembly (e.g., electrode assembly 160) coupled to the drill bit, and generating plasma at block 406 may comprise flowing electric current to the electrode assembly. In some embodiments, the plasma inducing apparatus (e.g., electrodes 160) may be coupled to a downhole end (e.g., downhole end 250*b* and cutting structure 290 of drill bit 250) of the drill bit.

Method 400 next includes weakening the subterranean formation with the plasma during the generating at block 408. For instance, in some embodiments weakening the subterranean formation may comprise forming cracks (e.g., cracks 170 in FIG. 3) in the subterranean formation) as a result of the plasma generated at 406. Method 400 also includes extending a borehole within the subterranean formation at block 410. In some embodiments, extending the borehole at 410 may directly result from the rotating, engaging, generating, and weakening of blocks 402, 404, 406, 408, previously described.

The embodiments disclosed herein have included drill bits and associated drilling systems or assemblies (e.g., system 10, BHA 100, drill bit 150) including electrode assemblies (e.g., electrodes 164 within electrode assemblies 160) configured to weaken a subterranean formation that is to be engaged by the drill bit and thereby increase the ROP during a drilling operation. Thus, through use of the embodiments disclosed herein, the time required to drill a borehole may be reduced, so that the costs associated with such a drilling operation may also be reduced.

While the embodiments described herein have included electrode assemblies (e.g., electrode assemblies 160) coupled to a downhole end of a drill bit (e.g., drill bit 150, 250, etc.), it should be appreciated that other embodiments may position electrode assemblies in different locations within system 10 either in lieu of or in addition to the electrode assemblies coupled to the bit as described above. For instance, in some embodiments, system 10 may include a reamer cutter disposed along or uphole of BHA 100 that includes one or more electrode assemblies that may be configured substantially the same as the electrode assemblies 160 described above.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A system for drilling a borehole in a subterranean formation, the system comprising:

a tubular string;

a drill bit coupled to the tubular string and comprising a bit body having a bit face positioned along the bit body;

a plasma inducing apparatus coupled to the drill bit and comprising an electrode assembly coupled to a downhole end of the drill bit, wherein the electrode assembly comprises one or more pairs of electrodes positioned along the bit face of the drill bit and configured to emit an electrical discharge between the one or more pairs of electrodes to generate plasma for weakening the subterranean formation, the electrical discharge having an average electrical power that is less than 20 kilowatts (kW); and a power conversion assembly coupled to the tubular string, wherein the plasma inducing apparatus is configured to generate plasma from electric current generated within the power conversion assembly, wherein the drill bit comprises a cutting structure positioned along the bit face and comprising a plurality of cutter elements configured to cut into the subterranean formation as the subterranean formation is weakened by the plasma generated by the electrode assembly.

2. The system of claim 1, wherein the plasma inducing apparatus comprises an electrode assembly coupled to a downhole end of the drill bit, wherein the electrode assembly is configured to emit an electrical discharge to generate plasma.

3. The system of claim 2, comprising:

a downhole motor coupled to the tubular string, wherein the downhole motor comprises a rotor and a stator; and wherein the power conversion assembly is coupled to the rotor of the downhole motor, and wherein the power conversion assembly is configured to generate electric current based on a rotation of the rotor within the stator.

4. The system of claim 3, wherein the downhole motor is a positive displacement motor that is configured to rotate the rotor within the stator in response to flowing a fluid between the rotor and the stator.

5. The system of claim 4, wherein the drill bit, the electrode assembly, the downhole motor, and the power conversion assembly are incorporated within a bottom hole assembly that is coupled to the tubular string.

6. The system of claim 5, wherein an instantaneous power release of the electrode assembly is greater than or equal to about 10 MW.

7. The system of claim 1, wherein the plasma inducing apparatus comprises plurality of electrode assemblies coupled to the drill bit, and wherein the power conversion assembly comprises a power distributor that is configured to sequentially provide electric current to the plurality of electrode assemblies.

8. The system of claim 1, wherein the plasma inducing apparatus comprises plurality of electrode assemblies coupled to the drill bit, wherein the electrode assemblies are configured to trace a plurality of radially spaced orbits about a central axis of the drill bit when the drill bit is rotated about the central axis.

9. A system for drilling a borehole in a subterranean formation, the system comprising:

a tubular string;

a bottom hole assembly coupled to the tubular string, the bottom hole assembly comprising:

a downhole motor comprising a stator and a rotor;

a power conversion assembly configured to generate electric current from operation of the downhole motor;

a drill bit having a central axis and comprising a bit body having a bit face positioned along the bit body, wherein the drill bit is rotatable about the central axis in response to relative rotation between the rotor and the stator of the downhole motor; and an electrode assembly coupled to a downhole end of the drill bit, wherein the electrode assembly is configured to generate plasma when energized with electric current from the power conversion assembly;

wherein the drill bit comprises a cutting structure positioned along the bit face and comprising a plurality of cutter elements configured to cut into the subterranean formation as the subterranean formation is weakened by the plasma generated by the electrode assembly.

10. The system of claim 9, comprising a plurality of electrode assemblies coupled to the downhole end of the drill bit, wherein the drill bit comprises a fixed cutter drill bit, and wherein the plurality of electrode assemblies are disposed within a cone region and shoulder region of the fixed cutter drill bit.

11. The system of claim 10, wherein the plurality of electrode assemblies are configured to trace a plurality of radially spaced orbits about a central axis of the drill bit when the drill bit is rotated about the central axis.

12. The system of claim 11, wherein the downhole motor is configured to drive rotation of the drill bit about the central axis.

13. The system of claim 9, wherein the power conversion assembly comprises:

an alternator coupled to the rotor of the downhole motor, and configured to generate an electric current as a result of rotation of the rotor;

a power storage assembly that is configured to store electrical power generated by the alternator; and a transformer electrically coupled to the power storage assembly and configured to increase a voltage of electric current.

14. The system of claim 13, wherein the power conversion assembly comprises a voltage multiplier electrically coupled between the transformer and the electrode assembly.

15. The system of claim 14, wherein the voltage multiplier comprises a Cockcroft-Walton generator.

16. A method of drilling a borehole in a subterranean formation, the method comprising:

(a) rotating a drill bit about a central axis, the drill bit comprising a bit body having a bit face positioned along the bit body;

(b) engaging the drill bit with the subterranean formation during (a);

(c) generating electric current downhole;

(d) emitting an electrical discharge between one or more pairs of electrodes of an electrode assembly positioned along the bit face of the drill bit to generate plasma during (b) using the electric current generated in (c), wherein the electrical discharge generated between the one or more pairs of electrodes has an average electrical power that is less than 20 kilowatts (KW);

(e) weakening the subterranean formation with the plasma during (d); and (f) cutting into the weakened subterranean formation with a plurality of cutting elements of a cutting structure positioned along the bit face to extend the borehole within a subterranean formation as a result of (a)-(e).

17. The method of claim 16, wherein (d) comprises forming one or more cracks in the subterranean formation.

18. The method of claim 17, wherein the plasma inducing apparatus comprises an electrode assembly, and wherein (d) comprises flowing the electric current generated in (c) to the electrode assembly.

19. The method of claim 18, wherein (d) comprises rotating a rotor of a downhole motor.

20. The method of claim 17, wherein (c) comprises sequentially generating plasma at a plurality of electrode assemblies coupled to the drill bit by sequentially energizing the plurality of electrode assemblies with a power distributor.

* * * * *